US011401874B2

(12) United States Patent
Ninomiya

(10) Patent No.: US 11,401,874 B2
(45) Date of Patent: Aug. 2, 2022

(54) ENGINE, VEHICLE AND ENGINE CONTROL METHOD

(71) Applicant: SUZUKI MOTOR CORPORATION, Hamamatsu (JP)

(72) Inventor: Yoshinari Ninomiya, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 90 days.

(21) Appl. No.: 17/006,505

(22) Filed: Aug. 28, 2020

(65) Prior Publication Data

US 2021/0071593 A1 Mar. 11, 2021

(30) Foreign Application Priority Data

Sep. 5, 2019 (JP) ..... JP2019-161874

(51) Int. Cl.

| | |
|---|---|
| ***F02D 13/00*** | (2006.01) |
| ***F02D 41/10*** | (2006.01) |
| ***F02D 13/02*** | (2006.01) |
| ***F02D 41/04*** | (2006.01) |
| ***F02F 1/42*** | (2006.01) |

(52) U.S. Cl.

CPC ..... *F02D 13/0234* (2013.01); *F02D 41/045* (2013.01); *F02F 1/4235* (2013.01)

(58) Field of Classification Search

CPC .... F02D 13/00; F02D 13/0234; F02D 41/045; F02D 41/10

USPC ..... 123/370, 399, 403, 580, 584, 682, 683

See application file for complete search history.

(56) References Cited

U.S. PATENT DOCUMENTS

| | | | | |
|---|---|---|---|---|
| 4,037,571 | A * | 7/1977 | Ishida | F02M 13/023 123/59.5 |
| 4,391,261 | A * | 7/1983 | Tomita | F02M 13/023 123/184.32 |
| 11,143,117 | B2 * | 10/2021 | Tanaka | F02D 41/008 |
| 2006/0048746 | A1 * | 3/2006 | Maehara | F02D 17/02 123/336 |
| 2008/0078355 | A1 * | 4/2008 | Maehara | F02M 35/10216 123/399 |
| 2010/0162997 | A1 | 7/2010 | Fukuuchi | 123/399 |
| 2016/0160763 | A1 * | 6/2016 | Matsuda | B62K 11/00 123/403 |

FOREIGN PATENT DOCUMENTS

| | | | |
|---|---|---|---|
| EP | 1548252 | * | 6/2005 |
| JP | 2010-59942 A | | 3/2010 |

* cited by examiner

*Primary Examiner* — Erick R Solis

(74) *Attorney, Agent, or Firm* — Stein IP, LLC

(57) ABSTRACT

An engine includes: an engine main body including a plurality of cylinders; a plurality of throttle valves positioned on intake sides of the plurality of cylinders; and a controller configured to control opening and closing operation of the plurality of throttle valves. Output of a part of the plurality of cylinders is larger than output of rest of the plurality of cylinders. And the controller opens a part of the throttle valves upstream of the part of the plurality of cylinders at a lower speed than rest of the throttle valves upstream of the rest of the plurality of cylinders.

9 Claims, 11 Drawing Sheets

ENGINE, VEHICLE AND ENGINE CONTROL METHOD

CROSS-REFERENCE TO RELATED APPLICATIONS

This application is based on Japanese Patent Application No. 2019-161874 filed on Sep. 5, 2019, the contents of which are incorporated herein by way of reference.

BACKGROUND

The present invention relates to an engine, a vehicle, and an engine control method.

As an engine mounted on a vehicle which is a straddle-type vehicle or the like, there has been known an engine in which exhaust ports are separated, which is a V-type engine, a horizontally opposed engine, or the like (for example, see Patent Literature 1). In this engine, a pair of front and rear cylinders are inclined in opposite directions, and a throttle valve is provided for each cylinder. Each throttle valve is attached to an intake pipe, and opens and closes in response to operation of a throttle grip to adjust an intake amount of air sent from the intake pipe to each cylinder. Engine output is controlled by changing a combustion efficiency of each cylinder according to the intake amount of each cylinder.

Patent Literature 1: JP-A-2010-59942

In the above-described engine, a combustion state may change for each cylinder at a start of opening of the throttle valve, and output may vary among a plurality of cylinders. When output deviation among the plurality of cylinders increases, a throttle shock indicating an excessive acceleration response occurs. In order to prevent the throttle shock, it may be possible to prevent the throttle valve from opening suddenly. However, an acceleration feeling may become unnatural.

SUMMARY

The present invention has been made in view of the above-described circumstances, and an object thereof is to provide an engine, a vehicle, and an engine control method that are capable of attaining vehicle control suitable for variations in output generated in a plurality of cylinders.

According to one advantageous aspect of the present invention, an engine includes: an engine main body including a plurality of cylinders; a plurality of throttle valves positioned on intake sides of the plurality of cylinders; and a controller configured to control opening and closing operation of the plurality of throttle valves. Output of a part of the plurality of cylinders is larger than output of rest of the plurality of cylinders. And the controller opens a part of the throttle valves upstream of the part of the plurality of cylinders at a lower speed than rest of the throttle valves upstream of the rest of the plurality of cylinders.

DESCRIPTION OF EMBODIMENTS

In an engine according to an aspect of the present invention, intake amounts of cylinders are adjusted by a plurality of throttle valves on intake sides of a plurality of cylinders, respectively. Output of a part of the plurality of cylinders is larger than output of rest of the plurality of cylinders, and the output varies among the plurality of cylinders. At a start of opening the throttle valves, a part of the throttle valves upstream of the part of the plurality of cylinders having large output is opened at a lower speed than rest of the throttle valves upstream of the rest of the plurality of cylinders. Accordingly, output deviation of the plurality of throttle valves decreases, and a throttle shock that indicates an excessive acceleration response at a moment when the throttle is opened, is prevented. The part of the throttle valves is opened at a low speed, so that it is possible to prevent a decrease in an acceleration feeling and to improve operability of the vehicle.

EMBODIMENT

Figure 1:
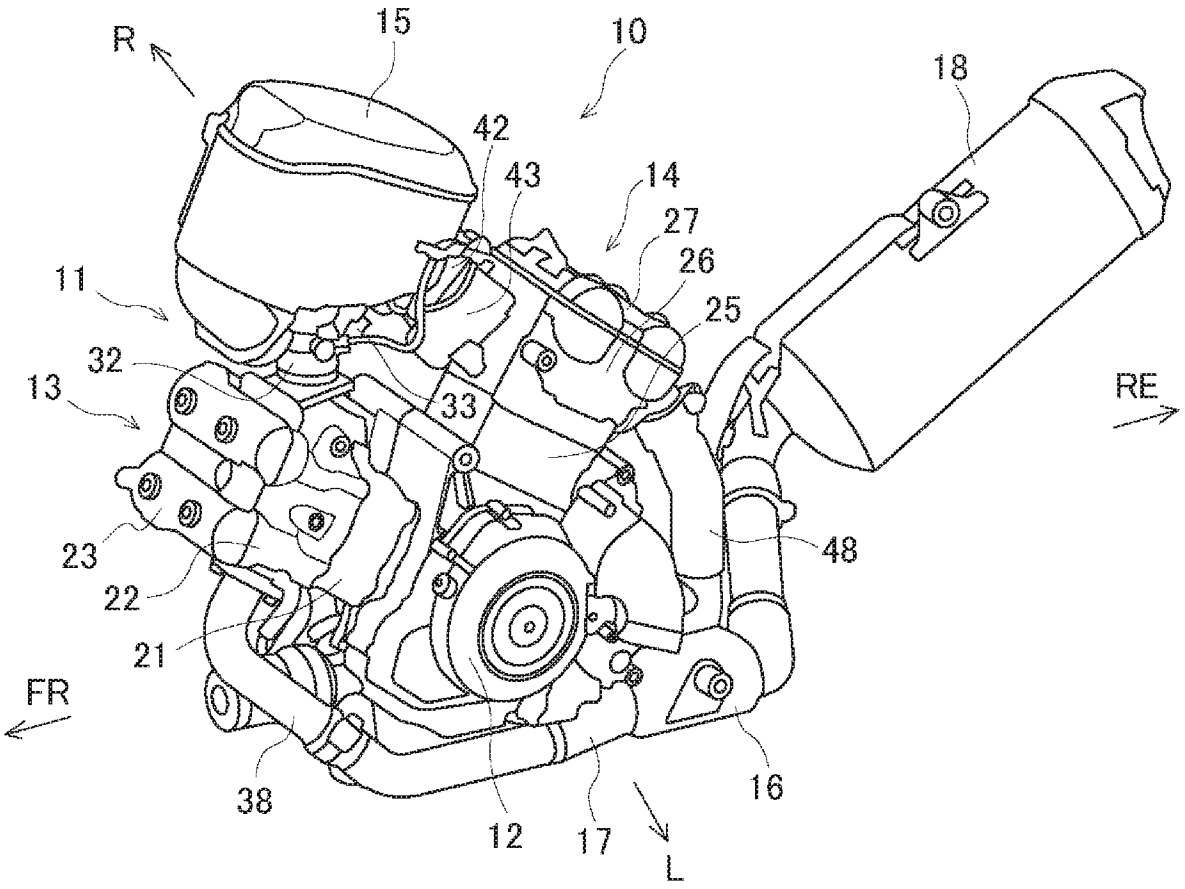
FIG. 1 is a perspective view of an engine according to a present embodiment.
Figure 2:
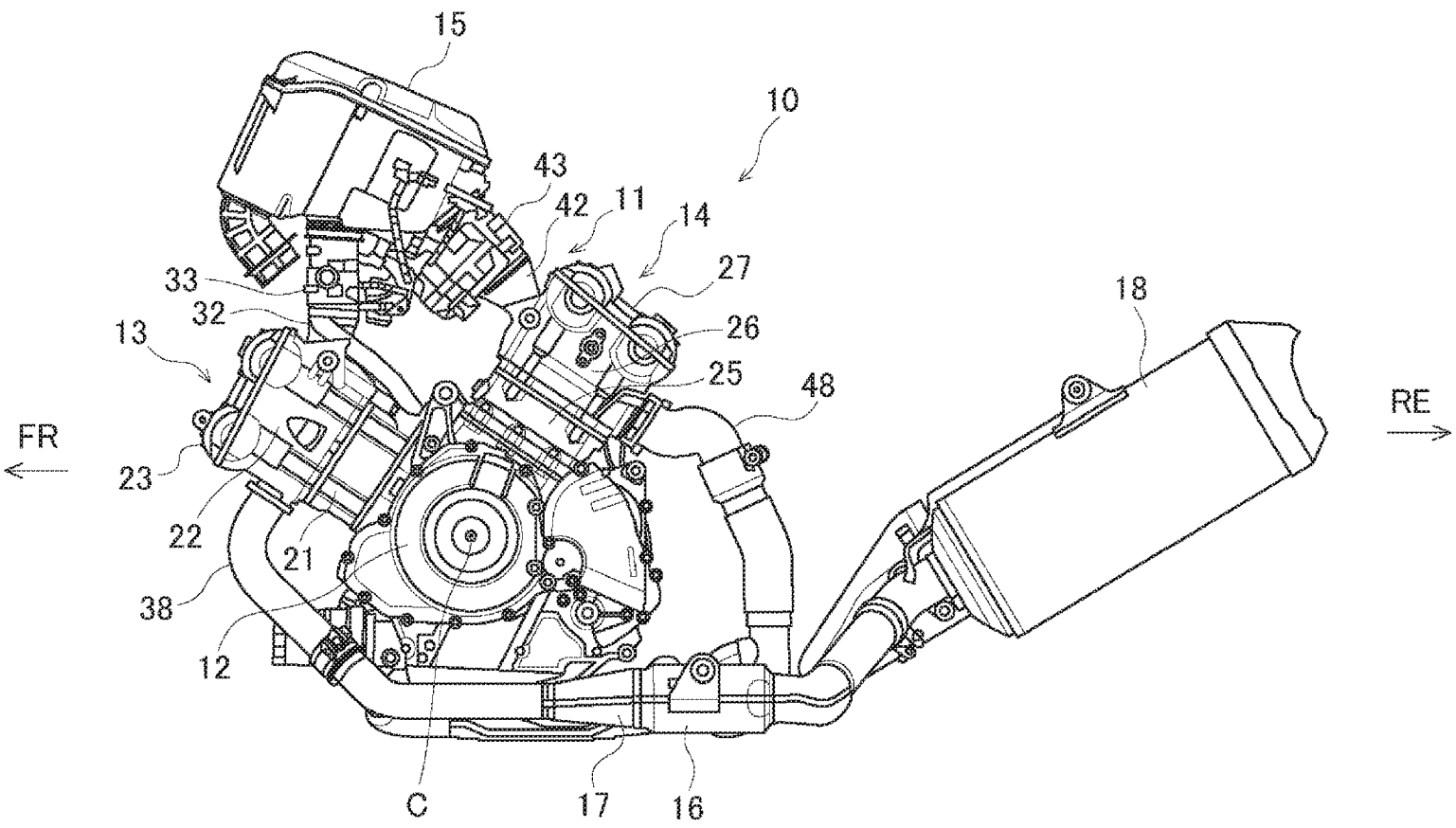
FIG. 2 is a side view of the engine according to the present embodiment.
Figure 3:
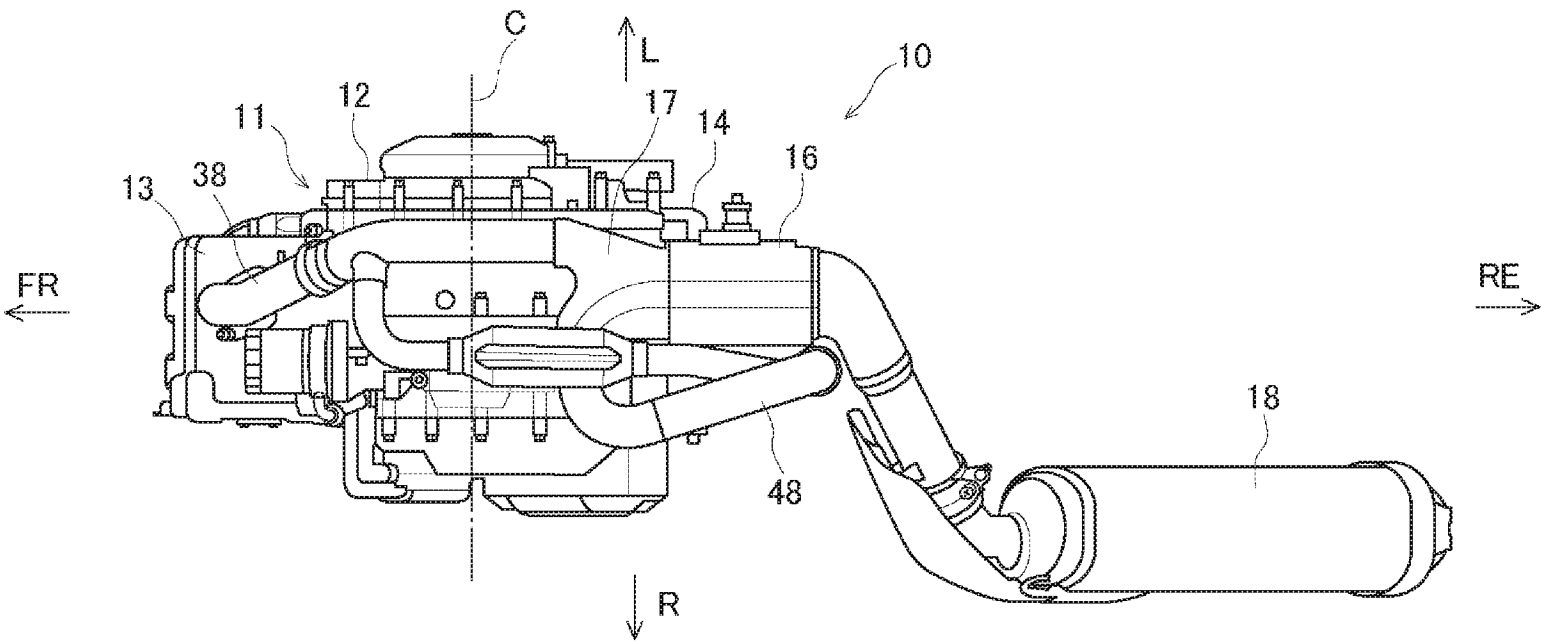
FIG. 3 is a bottom view of the engine according to the present embodiment.

Hereinafter, an embodiment will be described in detail with reference to the accompanying drawings. Here, an example in which an engine according to the present embodiment is applied to a motorcycle which is a straddle-type vehicle, will be described. However, an application object is not limited thereto. For example, the engine may be applied to other straddle-type vehicles which are a buggy-type automatic three-wheeled vehicle and the like. In the following drawings, a front side of a vehicle is indicated by an arrow FR, a rear side of the vehicle is indicated by an arrow RE, a left side of the vehicle is indicated by an arrow L, and a right side of the vehicle is indicated by an arrow R, respectively. FIG. 1 is a perspective view of the engine according to the present embodiment. FIG. 2 is a side view of the engine according to the present embodiment. FIG. 3 is a bottom view of the engine according to the present embodiment.

As illustrated in FIGS. 1 to 3, an engine 10 is a V-type engine in which explosion occurs at unequal intervals, and includes an engine main body II in which a front cylinder 13 and a rear cylinder 14 are provided on a crankcase 12 in a V shape. The front cylinder 13 is inclined toward the front side of the vehicle, and is formed by attaching a cylinder head 22 and a head cover 23 to a cylinder block 21 protruding from the crankcase 12. Similarly, the rear cylinder 14 is inclined toward the rear side of the vehicle, and is formed by attaching a cylinder head 26 and a head cover 27 to a cylinder block 25 protruding from the crankcase 12.

An intake port 31 (see FIG. 5) is opened in a rear surface of the front cylinder 13, and a front intake pipe 32 is connected to the intake port 31. An intake port 41 (see FIG. 5) is opened in a front surface of the rear cylinder 14, and a rear intake pipe 42 is connected to the intake port 41. The front and rear intake pipes 32, 42 respectively extend upward from the front and rear cylinders 13, 14, and are connected to a lower part of an air cleaner 15 configured to filter outside air. A front throttle body 33 for the front cylinder 13 is provided at an intermediate part of the front intake pipe 32, and a rear throttle body 43 for the rear cylinder 14 is provided at an intermediate part of the rear intake pipe 42.

Figure 5:
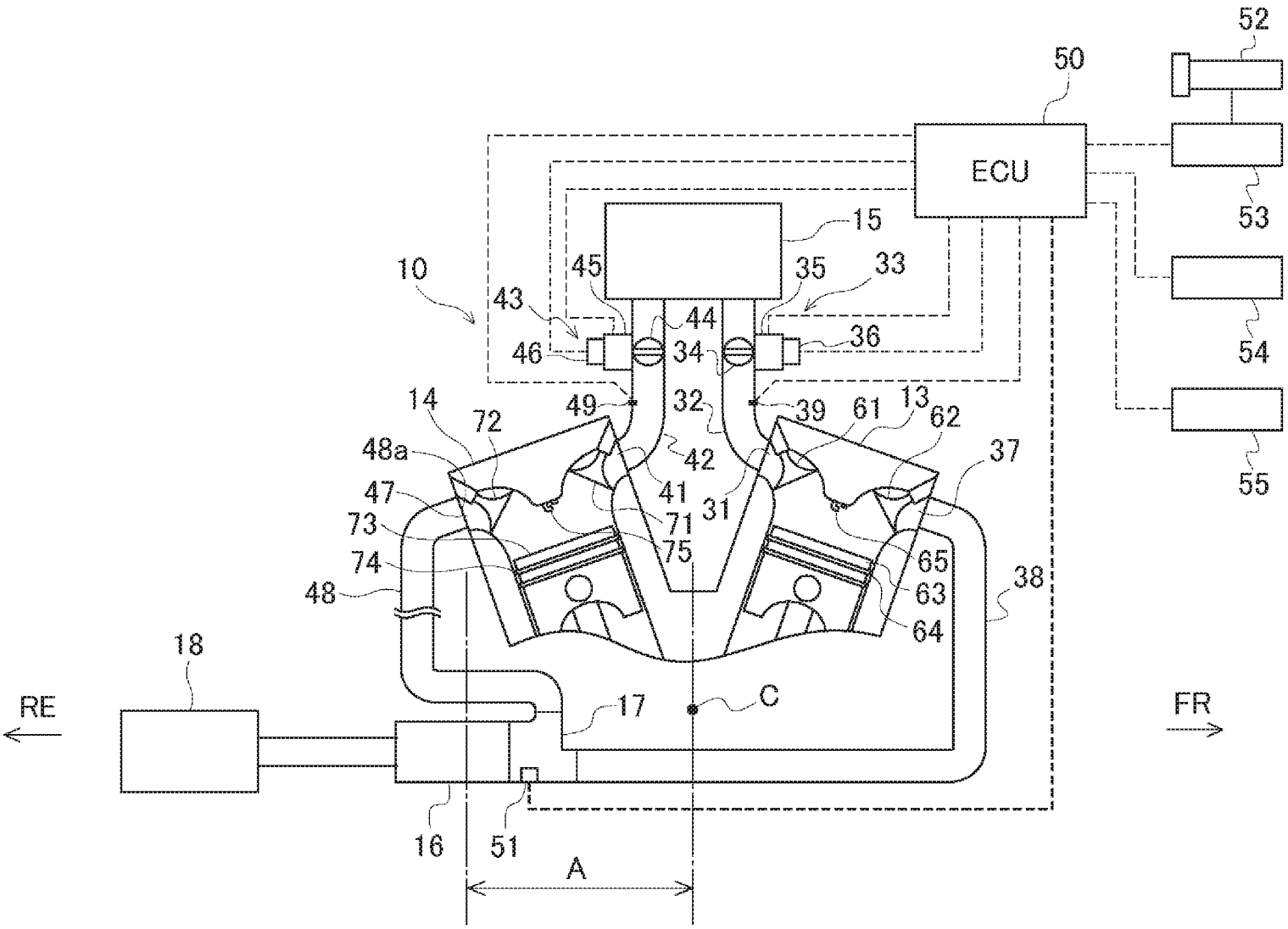
FIG. 5 is a schematic view of the engine according to the present embodiment.

The front throttle body 33 is provided with a front throttle valve 34 (see FIG. 5) configured to adjust an intake amount of the front cylinder 13, and the rear throttle body 43 is provided with a rear throttle valve 44 configured to adjust an intake amount of the rear cylinder 14 (see FIG. 5). The front and rear throttle bodies 33, 43 are electronic throttle bodies, and include motors 35, 45 (see FIG. 5) configured to drive the front and rear throttle valves 34, 44 to open and close. The front and rear throttle bodies 33, 43 individually include the motors 35, 45, so that it is possible to individually control the front and rear throttle valves 34, 44 to adjust the intake amounts for the respective cylinders.

An exhaust port 37 (see FIG. 5) is opened in a front surface of the front cylinder 13, and a front exhaust pipe 38 is connected to the exhaust port 37. An exhaust port 47 (see FIG. 5) is opened in a rear surface of the rear cylinder 14, and a rear exhaust pipe 48 is connected to the exhaust port 47. The front and rear exhaust pipes 38, 48 extend downward from the front and rear cylinders 13, 14, respectively, and are connected to a catalytic device 16 configured to purify air pollutants in exhaust gas. The catalytic device 16 is provided at a rear part of the vehicle, below the engine 10, and closer to the rear side of the vehicle than a center C of a crankshaft in the crankcase 12.

The rear exhaust pipe 48 is connected to the catalytic device 16 below the engine 10 through a path that is more complicated than that of the front exhaust pipe 38. Therefore, pipe lengths from outlets of the exhaust ports 37, 47 to inlets of the catalyst device 16 are different between the front exhaust pipe 38 and the rear exhaust pipe 48, and the pipe length of the front exhaust pipe 38 continuous with the front cylinder 13 is shorter than the pipe length of the rear exhaust pipe 48 continuous with the rear cylinder 14. Pipe shapes of the front and rear exhaust pipes 38, 48 will be described below in detail. The front and rear exhaust pipes 38, 48 are connected to the catalytic device 16 via a collecting pipe 17, and a silencer (a muffler) 18 configured to silence an exhaust noise is provided downstream of the catalytic device 16.

In the engine 10 configured as described above, air flows from the air cleaner 15 toward the front cylinder 13 and the rear cylinder 14 via the front and rear intake pipes 32, 42. The front and rear throttle valves 34, 44 adjust the intake amounts to the front and rear cylinders 13, 14, and a fuel supply device (not illustrated) mixes a fuel with the air and sends an air-fuel mixture into the cylinders 13, 14. The exhaust gas after combustion flows into the catalyst device 16 through the front and rear exhaust pipes 38, 48 from the cylinders 13, 14, and is exhausted from the silencer 18 after the air pollutants have been purified by the catalytic device 16.

A general motorcycle engine is a high-speed and high-power engine. A throttle bore diameter of a cylinder is large for an exhaust amount, and a throttle shock may occur when the throttle valve starts to open from a fully closed state. In an engine in which explosion occurs at unequal intervals, combustion states of respective cylinders are different when the throttle valves start to open from the fully closed state, and output varies among the cylinders. In particular, when the exhaust pipes of the cylinders have unequal lengths as in the V-type engine, output deviation of the cylinders becomes large, and the throttle shock is likely to occur.

Figure 4:
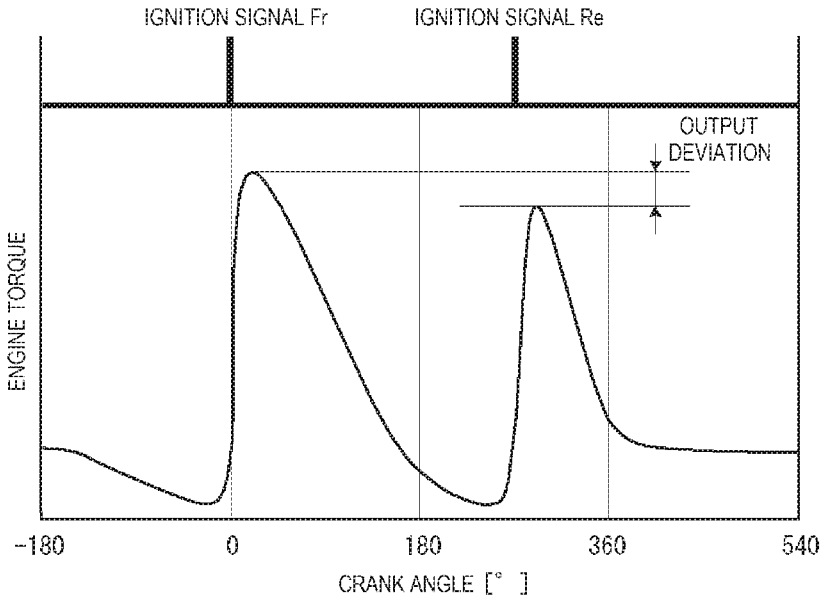
FIG. 4 is a schematic diagram of a torque fluctuation of a general V twin engine.

For example, as shown in FIG. 4, at a crank angle of 0 degree, the ignition signal Fr is input to the front cylinder and engine torque increases rapidly, and at a crank angle of 270 degrees, the ignition signal Re is input to the rear cylinder and the engine torque increases rapidly. In this case, due to a layout of the V-type engine and unequal lengths of the exhaust pipes of the cylinders, output deviation occurs between the front and rear cylinders. The engine torque of the front cylinder fluctuates more greatly than the engine torque of the rear cylinder. As described above, in the V-type engine whose exhaust pipes have unequal lengths, the output deviation becomes large, and the throttle shock is likely to occur.

The engine 10 according to the present embodiment is a V-type engine in which the front exhaust pipe 38 is shorter than the rear exhaust pipe 48. In this case, output of the front cylinder 13 becomes larger than output of the rear cylinder 14, and the throttle shock may occur in the engine 10 due to the output deviation between the front and rear cylinders 13, 14. Therefore, in the present embodiment, focusing on a fact that the output of the front cylinder 13 is higher than that of the rear cylinder 14, the throttle shock is prevented by opening the front throttle valve 34 at a lower speed than the rear throttle valve 44 when the throttle valve starts to open.

Figure 6:
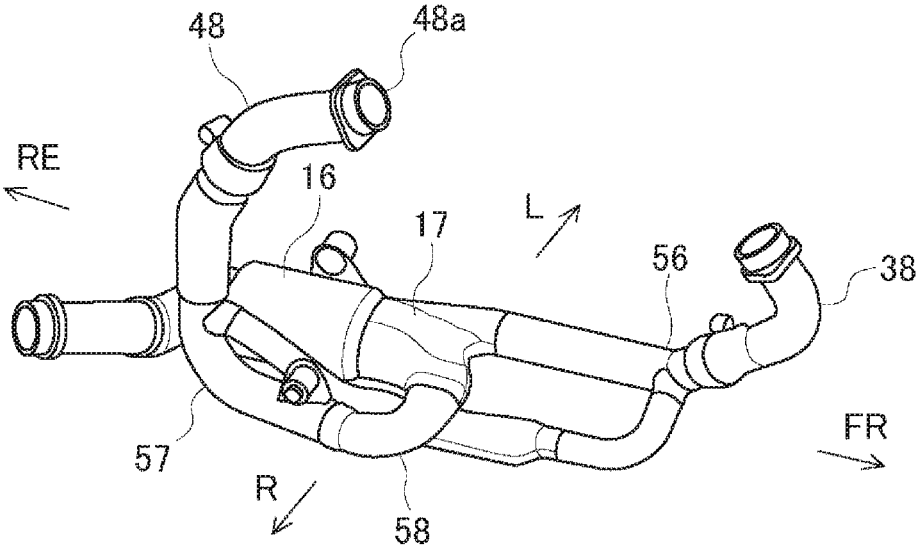
FIG. 6 is a perspective view of an exhaust device according to the present embodiment.

Hereinafter, a detailed configuration of the engine of the present embodiment will be described with reference to FIGS. 5 and 6. FIG. 5 is a schematic view of the engine according to the present embodiment. FIG. 6 is a perspective view of the exhaust device according to the present embodiment.

As illustrated in FIG. 5, an intake valve 61 configured to open and close the intake port 31 so as to introduce the air-fuel mixture into the cylinder is provided on the intake side of the front cylinder 13. An exhaust valve 62 configured to open and close the exhaust port 37 so as to exhaust the exhaust gas from inside of the cylinder is provided on an exhaust side of the front cylinder 13. A piston 63 is housed in a cylinder of the front cylinder 13 so that the piston 63 can reciprocate, and a piston ring 64 configured to seal a gap between a piston outer surface and a cylinder inner wall surface is mounted on the piston 63. An ignition plug 65 configured to ignite the air-fuel mixture in the combustion chamber protrudes from an upper part of the front cylinder 13.

The rear cylinder 14 is formed in the same manner as the front cylinder 13. That is, the rear cylinder 14 is provided with an intake valve 71 configured to open and close the intake port 41, an exhaust valve 72 configured to open and close the exhaust port 47, and a piston 73 housed in the cylinder. An ignition plug 75 configured to ignite the air-fuel mixture in the combustion chamber protrudes from an upper part of the rear cylinder 14. Explosion occurs at unequal intervals in the front cylinder 13 and the rear cylinder 14, and the output varies due to a difference in a combustion state (an intake amount) between the front cylinder 13 and the rear cylinder 14 or the like.

The air cleaner 15 is connected to the intake port 31 of the front cylinder 13 via the front intake pipe 32, and the front throttle body 33 is provided in a middle of the front intake pipe 32. The front throttle body 33 is provided with the front throttle valve 34 configured to open and close in response to operation of an accelerator grip 52. The intake amount of air sent into the front cylinder 13 is adjusted according to an opening degree of the front throttle valve 34. The front throttle body 33 is provided with the motor 35 connected to the front throttle valve 34 and a throttle sensor 36 configured to detect the opening degree of the front throttle valve 34. An intake pressure sensor 39 configured to detect an intake pressure is provided in the front intake pipe 32.

Similarly, the air cleaner 15 is connected to the intake port 41 of the rear cylinder 14 via the rear intake pipe 42, and the rear throttle body 43 is provided in a middle of the rear intake pipe 42. The rear throttle body 43 is provided with the rear throttle valve 44 configured to open and close in response to the operation of the accelerator grip 52. The intake amount of air sent into the rear cylinder 14 is adjusted according to an opening degree of the rear throttle valve 44. The rear throttle body 43 is provided with the motor 45 connected to the rear throttle valve 44 and a throttle sensor 46 configured to detect the opening degree of the rear throttle valve 44. An intake pressure sensor 49 configured to detect an intake pressure is provided in the rear intake pipe 42.

The front exhaust pipe 38 is connected to the exhaust port 37 of the front cylinder 13, and the rear exhaust pipe 48 is connected to the exhaust port 47 of the rear cylinder 14. The front and rear exhaust pipes 38, 48 are combined into one by the collecting pipe 17 and are connected to the catalytic device 16, and the silencer 18 is connected downstream of the catalytic device 16. In the catalytic device 16, the air pollutants which are carbon monoxide (CO), hydrocarbons (HC), nitrogen oxides (NOx), and the like contained in the exhaust gas, are purified. The catalytic device 16 does not function sufficiently at a low temperature, but may malfunction and break when being too hot. Therefore, an exhaust temperature sensor 51 configured to measure an exhaust temperature is provided in a vicinity of the catalytic device 16.

As described above, a flow path from the front intake pipe 32 to the front exhaust pipe 38 through the front cylinder 13 and a flow path from the rear intake pipe 42 to the rear exhaust pipe 48 through the rear cylinder 14 are formed independently in the engine 10. The front and rear exhaust pipes 38, 48 join at the collecting pipe 17 upstream of the catalytic device 16. However, the collecting pipe 17 is positioned in a range A that is closer to the vehicle rear side than the center C of the crankshaft in the crankcase 12 and that is closer to the vehicle front side than an upstream end 48*a* of the rear exhaust pipe 48. Therefore, more bendings are formed on the rear exhaust pipe 48 extending from the rear cylinder 14 to the catalyst device 16 than on the front exhaust pipe 38 extending from the front cylinder 13 to the catalyst device 16.

More specifically, as illustrated in FIG. 6, the front exhaust pipe 38 extends obliquely downward from the front surface of the front cylinder 13 toward the rear, and then is bent at a bent portion 56 at a gentle bending angle toward the vehicle rear side. After extending downward from the rear surface of the rear cylinder 14, the rear exhaust pipe 48 is bent at a bent portion 57 at a sharp bending angle toward the vehicle front side, and is further bent at a bent portion 58 at a sharp bending angle toward an inner side (a left side) of the vehicle. The rear exhaust pipe 48 passes through a path that is more complicated than that of the front exhaust pipe 38, so that the rear exhaust pipe 48 has more sharp bendings than that of the front exhaust pipe 38 and has a long pipe length.

As illustrated in FIG. 5, the engine 10 is provided with an electrical control unit (ECU) 50 configured to control units of the engine based on output from various sensors. An accelerator position sensor 53, a shift position sensor 54, a crank angle sensor 55, and the like are connected to the ECU 50 in addition to the throttle sensors 36, 46 and the intake pressure sensors 39, 49. The accelerator position sensor 53 is configured to detect the operation of the accelerator grip 52, the shift position sensor 54 is configured to detect a shift position of a transmission, and the crank angle sensor 55 is configured to detect a rotation angle of the crankshaft. A part of the ECU 50 functions as a control unit (controller) 80 (see FIG. 7) configured to control opening and closing operation of the front and rear throttle valves 34, 44.

As described above, the front exhaust pipe 38 has less sharp bending and a short pipe length, so that exhaust efficiency of the front cylinder 13 is higher than that of the rear cylinder 14 due to pulsation generated in intake and exhaust processing. Therefore, when the accelerator grip 52 is quickly opened, the front throttle valve 34 is opened at a lower speed than the rear throttle valve 44 by the ECU 50 so that the output of the front cylinder 13 does not become too large. Accordingly, the throttle shock is prevented when the front and rear throttle valves 34, 44 start to open from a fully closed state, smooth acceleration is attained, and the operability of the vehicle is improved.

Figure 7:
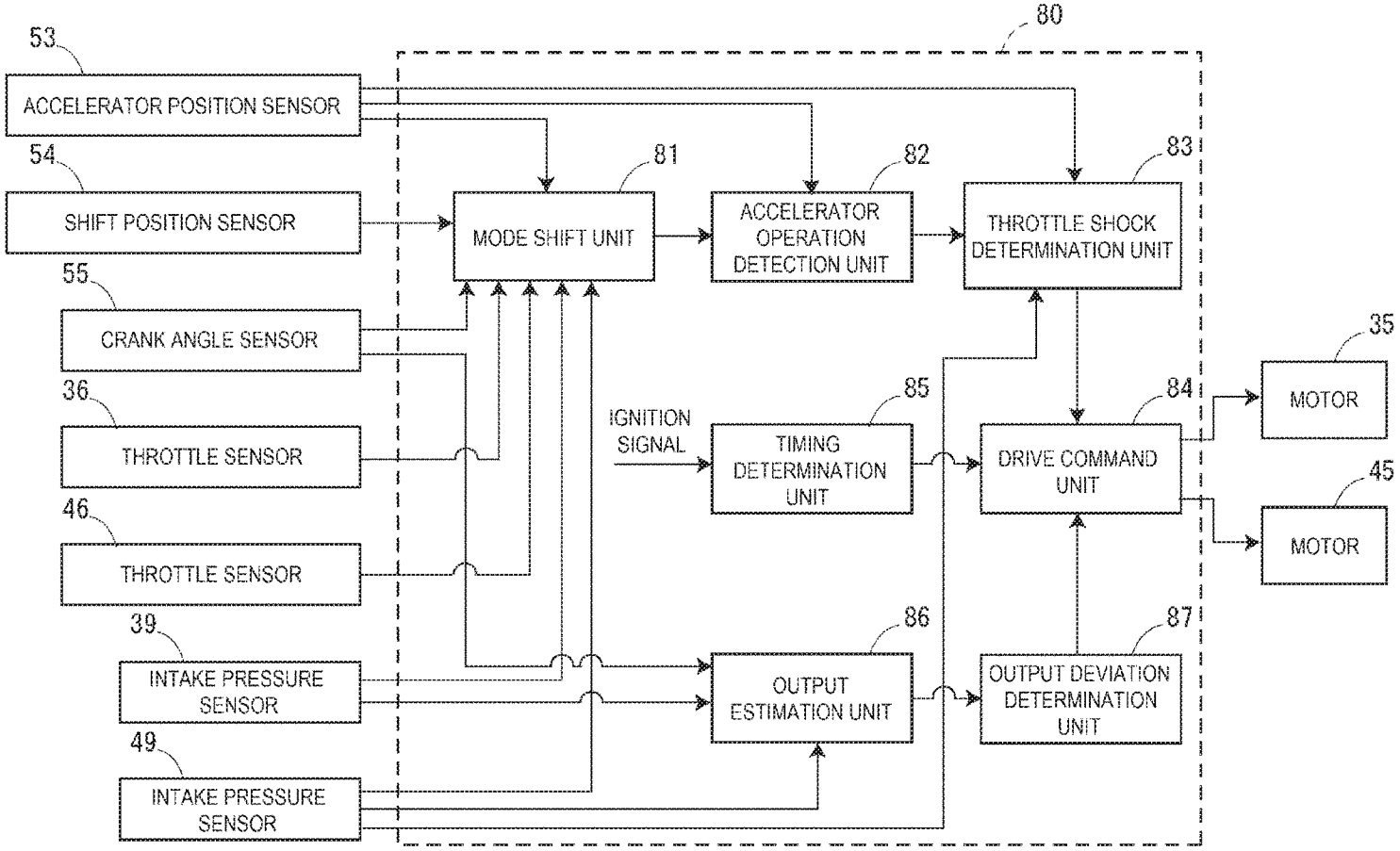
FIG. 7 is a control block diagram of the engine according to the present embodiment.
Figure 8:
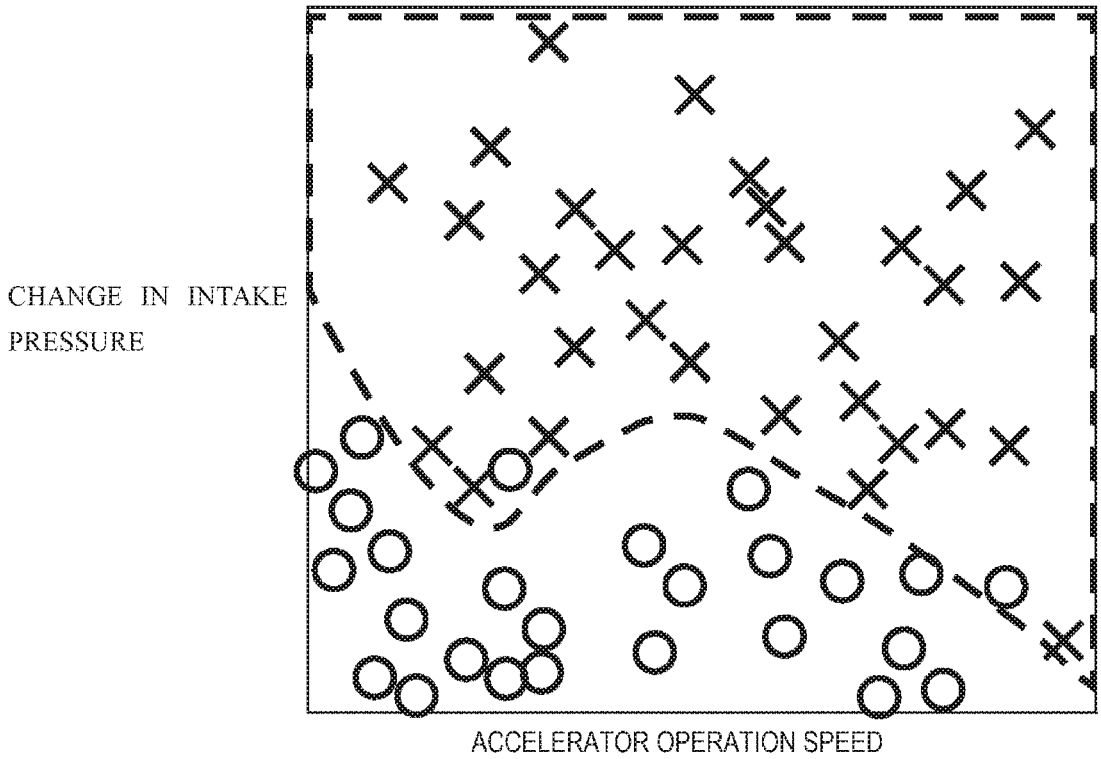
FIG. 8 is a diagram showing map data for determining a throttle shock according to the present embodiment.

A control configuration of the engine according to the present embodiment will be described with reference to FIGS. 7 and 8. FIG. 7 is a control block diagram of the engine according to the present embodiment. FIG. 8 is a diagram showing map data for determining a throttle shock according to the present embodiment.

As shown in FIG. 7, the control unit 80 is provided with a mode shift unit 81, an accelerator operation detection unit 82, a throttle shock determination unit 83, a drive command unit 84, a timing determination unit 85, an output estimation unit 86, and an output deviation determination unit 87. The mode shift unit 81 is configured to shift an operation mode of the control unit 80 to a detection mode, and to start monitoring the throttle shock. Shift conditions of the detection mode only need to include that at least the front and rear throttle valves 34, 44 are fully closed. The shift conditions of the detection mode may further include that the shift position is not neutral and that an engine rotation speed is an idle rotation speed.

The full closing of the front and rear throttle valves 34, 44 may be detected when a detected opening degree of the accelerator position sensor 53 is smaller than a determined opening degree. The full closing of the front and rear throttle valves 34, 44 may be detected when detected opening degrees of the front and rear throttle sensors 36, 46 are smaller than a determined opening degree. The full closing of the front and rear throttle valves 34, 44 may be detected when detected pressures of the front and rear intake pressure sensors 39, 49 are smaller than a determined intake pressure. The plurality of shift conditions may be appropriately combined and set according to a situation where the throttle shock occurs.

The accelerator operation detection unit 82 is configured to detect accelerator operation for increasing the opening degree of the front and rear throttle valves 34, 44. In this case, based on a difference between a previous detected opening degree and a current detected opening degree of the accelerator position sensor 53, the accelerator operation for opening the front and rear throttle valves 34, 44 from the fully closed state is detected. The throttle shock occurs while the accelerator is operated, so that throttle shock determination processing is performed using the accelerator operation as a trigger. The accelerator operation detection unit 82 may detect an accelerator operation speed and use the accelerator operation speed which is equal to or higher than a determined speed as the trigger of the throttle shock determination processing.

After the accelerator operation is detected, the throttle shock determination unit 83 sets detection time Tts (Tts≥0) of the throttle shock in a timer (not shown). The timer counts down the detection time Tts according to elapse of time. For example, when Tts=10 is satisfied, Tts=9 is satisfied when 1 [s] has elapsed in real time. The throttle shock determination unit 83 is configured to determine whether the throttle shock indicating an excessive acceleration response to the accelerator operation occurs during the elapse of the detection time Tts. Whether the throttle shock occurs is determined based on the accelerator operation speed and a change in the intake pressure of the rear cylinder 14.

As shown in FIG. 8, the throttle shock determination unit 83 determines the throttle shock based on map data in which a region where the throttle shock occurs and a region where the throttle shock does not occur are divided. A horizontal axis of the map data is the accelerator operation speed, and a vertical axis of the map data is the change in the intake pressure of the rear cylinder 14. The map data indicates that, as the accelerator operation speed increases, the change in the intake pressure does not catch up with the accelerator operation and sharp output delays, so that the throttle shock occurs. The accelerator operation speed is obtained by differentiating the accelerator position in unit time, and the change in the intake pressure is obtained by differentiating the intake pressure of the rear cylinder 14 in unit time. The map data is set experimentally, empirically, or theoretically based on past data or the like.

Cross marks on the map data indicate a plot in which the throttle shock occurs, and circle marks on the map data indicate a plot in which the throttle shock does not occur. In a region surrounded by a broken line of the map data, the throttle shock occurs. When the change in the intake pressure and the accelerator operation speed are plotted in the region where the throttle shock occurs during the elapse of the detection time Tts, it is determined that the throttle shock occurs, and determination flag is set to 1. When the change in the intake pressure and the accelerator operation speed are plotted outside the region where the throttle shock occurs during the elapse of the detection time Tts, it is determined that the throttle shock does not occur, and the determination flag is set to 0.

Figure 10:
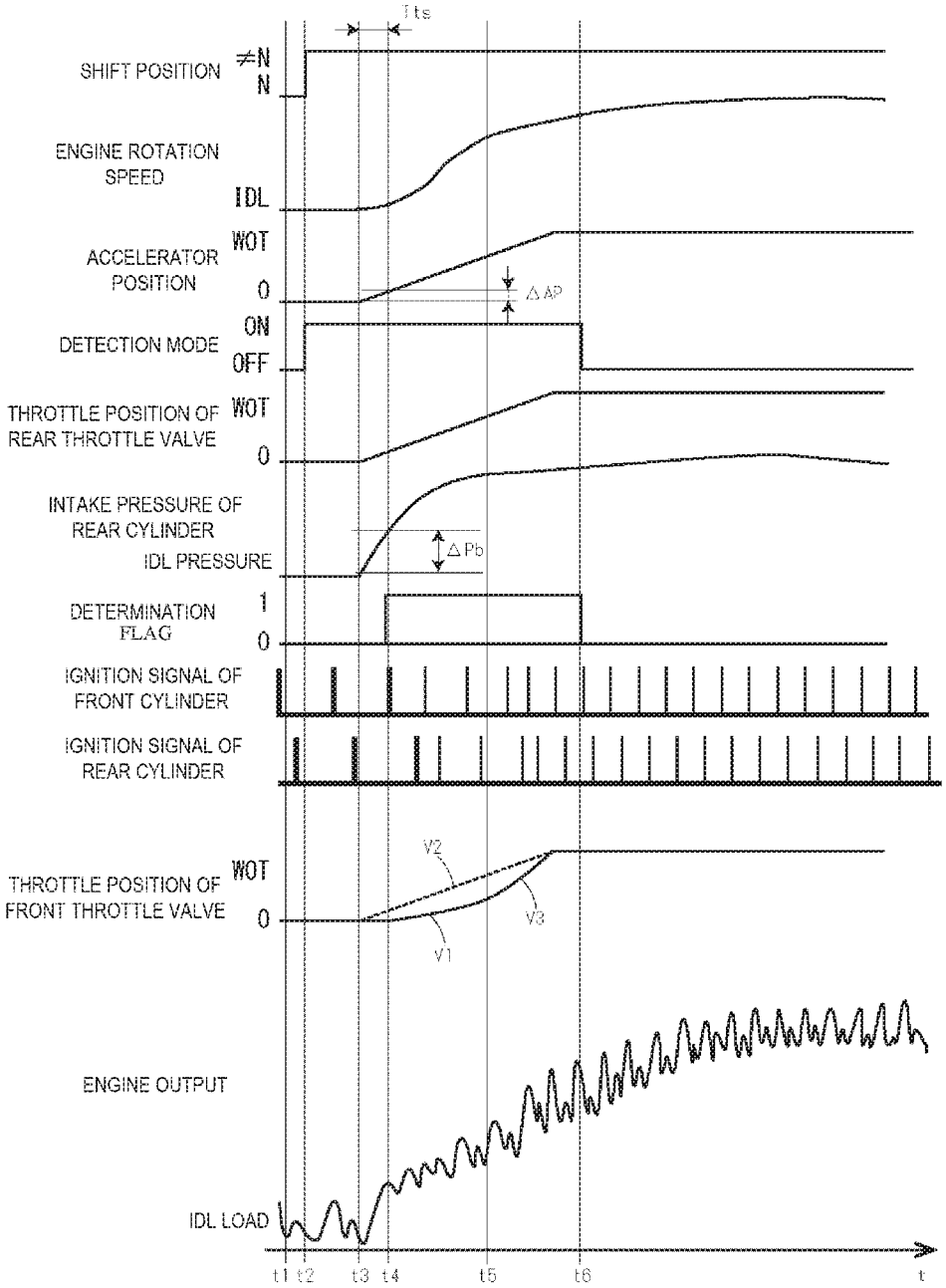
FIG. 10 is a diagram showing a time chart when an accelerator is operated according to the present embodiment.

A reason why the change in the intake pressure of the rear cylinder 14 is used to determine the throttle shock is that only the rear throttle valve 44 on the side of the rear cylinder 14 follows the accelerator operation during the elapse of the detection time Tts (see FIG. 10). The throttle shock occurs due to the fact that the change in the intake pressure does not catch up with the accelerator operation, so that the throttle shock determination unit 83 may determine the throttle shock of the front cylinder 13 based only on the accelerator operation speed. That is, the throttle shock determination unit 83 may determine that the throttle shock occurs when the accelerator operation speed exceeds the determined speed.

The drive command unit 84 is configured to generate a drive command for the front and rear throttle valves 34, 44 based on the determination flag of the throttle shock. When the determination flag is set to 1, it is determined that the throttle shock occurs, and a low-speed drive command for the front throttle valve 34 (see FIG. 5) is generated. When the determination flag is set to 0, it is determined that the throttle shock does not occur, and a normal drive command for the front throttle valve 34 is generated. Regardless of a value of the determination flag, a normal drive command for the rear throttle valve 44 (see FIG. 5) is generated. The normal drive follows the accelerator position.

Thus, when the throttle shock determination unit 83 determines that the throttle shock occurs, the low-speed drive command is output from the drive command unit 84 to the motor 35 of the front throttle valve 34. The front throttle valve 34 is opened at a lower speed than the rear throttle valve 44, and the intake amount of the front cylinder 13 is reduced, so that the output of the front cylinder 13 is prevented. Accordingly, the output deviation of the front and rear cylinders 13, 14 decreases, and the throttle shock is prevented when the front and rear throttle valves 34, 44 start to open from the fully closed state by the accelerator operation.

The timing determination unit 85 is configured to determine an output timing of the drive command for the front and rear throttle valves 34, 44. The low-speed drive command for the front throttle valve 34 is output from the drive command unit 84 to the motor 35 according to an input timing of the ignition signal of the front cylinder 13 after the detection time Tts has elapsed from a detection timing of the accelerator operation. The normal drive command for the rear throttle valve 44 is output from the drive command unit 84 to the motor 45 according to the detection timing of the accelerator operation (see FIG. 10). Therefore, the front throttle valve 34 starts to open slightly later than the rear throttle valve 44.

The output estimation unit 86 is configured to estimate the output of the front and rear cylinders 13, 14. The output of the front and rear cylinders 13, 14 is estimated based on the intake pressure and the engine rotation speed. The intake pressures of the front and rear cylinders 13, 14 are detected by the intake pressure sensors 39, 49, respectively. The engine rotation speed is calculated based on a detected value of the crank angle sensor 55. The output deviation determination unit 87 is configured to calculate the output deviation of the front cylinder 13 and the rear cylinder 14 after the detection time Tts has elapsed, and to determine whether the output deviation falls within a predetermined range, that is, whether the throttle shock has been sufficiently prevented.

A determination result of the output deviation determination unit 87 is input to the drive command unit 84, and is used for speed adjustment after the front throttle valve 34 has started to move. Until the output deviation of the front and rear cylinders 13, 14 falls within the predetermined range, the low-speed drive command is output from the drive command unit 84 to the motor 35 of the front throttle valve 34. The front throttle valve 34 is opened at a lower speed than the rear throttle valve 44, and the output deviation between the front and rear cylinders 13, 14 is reduced, so that the throttle shock is prevented. As described above, the front throttle valve 34 is opened at a low speed until the throttle shock does not occur.

After the output deviation of the front and rear cylinders 13, 14 has fallen within the predetermined range, a high-speed drive command is output from the drive command unit 84 to the motor 35 of the front throttle valve 34. The front throttle valve 34 is opened at a higher speed than the rear throttle valve 44 until the opening degree of the front throttle valve 34 matches the opening degree of the rear throttle valve 44. As described above, after the front throttle valve 34 has been opened at a low speed to prevent the throttle shock, the front throttle valve 34 is opened at a high speed to enhance the acceleration response, so that the operability of the vehicle is improved.

In the present embodiment, it is assumed that the output of the front cylinder 13 is larger than the output of the rear cylinder 14, and the front throttle valve 34 is opened at a lower speed than the rear throttle valve 44. However, the present invention is not limited to this configuration. A cylinder having a large output may be estimated from a plurality of cylinders, and a throttle valve upstream of this cylinder may be opened at a lower speed than other throttle valve. The cylinder having a large output is estimated based on, for example, an estimation result of the output estimation unit 86 and the determination result of the output deviation determination unit 87.

In the present embodiment, the output deviation determination unit 87 determines whether the throttle shock is prevented based on the output deviation of the front and rear cylinders 13, 14. However, the present invention is not limited to this configuration. It may be determined whether the throttle shock is prevented based on engine output of the engine 10. When the engine output is smaller than determined output, it is determined that the throttle shock has been prevented, and an opening speed of the front throttle valve 34 is switched from the low speed to the high speed. It may be determined that the throttle shock has been prevented when sufficiently long time has elapsed from the elapse of the detection time Tts.

Units of the control unit 80 may be implemented by software using a processor, or may be implemented by a logic circuit (hardware) formed in an integrated circuit or the like. When a processor is used, the processor reads and executes a program stored in a memory, so that various types of processing is performed. As the processor, for example, a central processing unit (CPU) is used. The memory includes one or a plurality of storage media which are a read only memory (ROM), a random access memory (RAM), and the like, depending on application. In addition to the program, various parameters, map data, and the like are stored in the memory.

Figure 9:
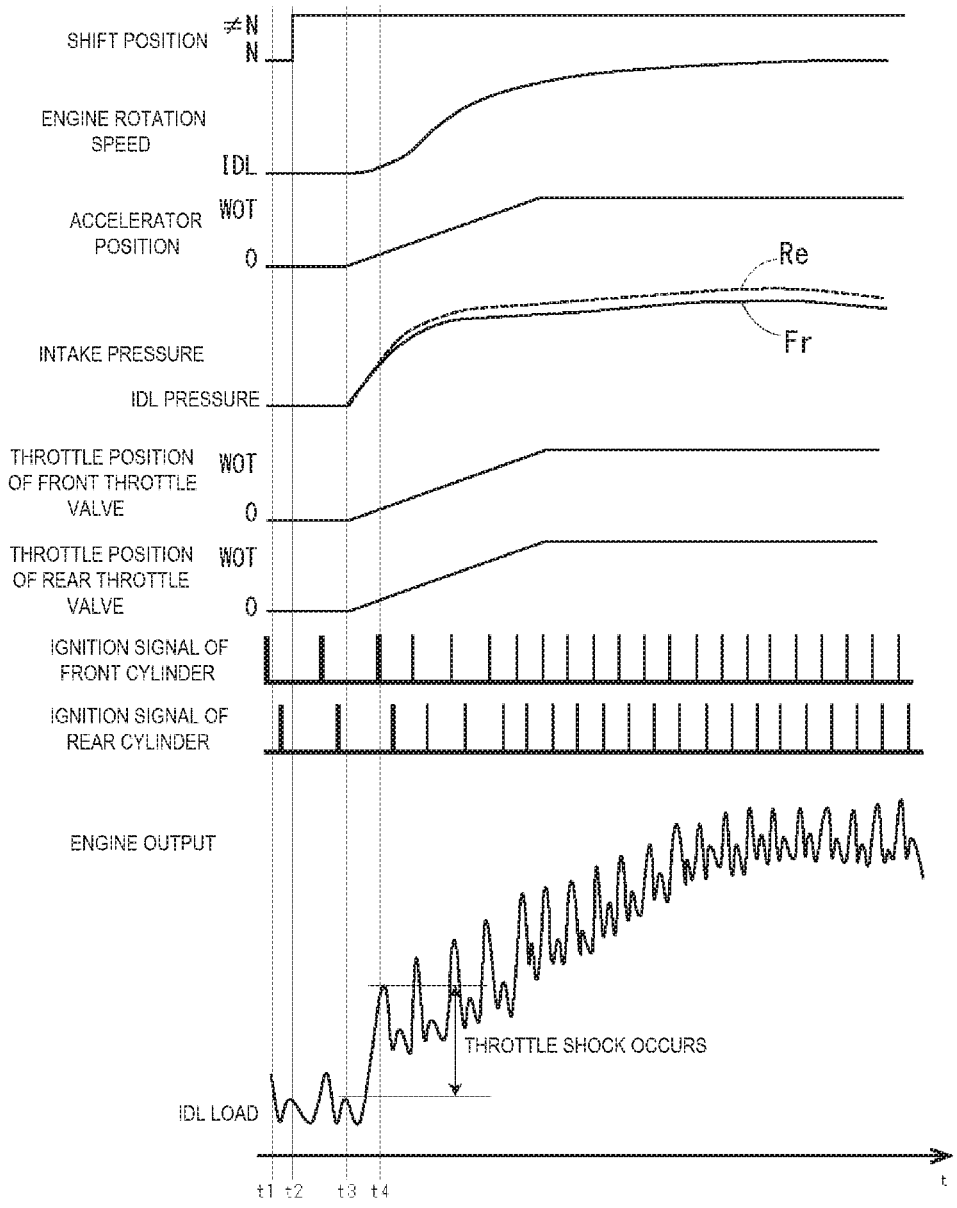
FIG. 9 is a diagram showing a time chart when an accelerator is operated in a comparative example.

Operation images of the front and rear throttle valves will be described with reference to FIGS. 9 and 10. FIG. 9 is a diagram showing a time chart when an accelerator is operated in a comparative example. FIG. 10 is a diagram showing a time chart when the accelerator is operated according to the present embodiment. Here, reference signs in FIG. 5 will be used as appropriate, and the same components as those in the present embodiment will be denoted by the same reference signs in the comparative example for description.

In the comparative example in FIG. 9, when the accelerator is not operated at a time t1, the engine rotation speed is the idle rotation speed, the accelerator position is a fully closed position, the intake pressure is an idle pressure, and throttle positions of the front and rear throttle valves 34, 44 are fully closed positions. At a time t2, the shift position is changed from neutral. At a time t3, the accelerator is operated, the accelerator position is moved from the fully closed position, and the throttle positions of the front and rear throttle valves 34, 44 are moved from the fully closed position following the accelerator position. At this time, the intake pressures of the front cylinder 13 and the rear cylinder 14 increase, and the intake amounts of air to the front cylinder 13 and the rear cylinder 14 increase.

When the ignition signal is input to the front cylinder 13 at a time t4, the engine output sharply increases, and deviation of the engine output before and after the accelerator operation increases. In particular, when the front cylinder 13 burns at a timing after the accelerator operation, the output deviation of the engine output becomes too large, and the throttle shock occurs. As described above, when movement of the front and rear throttle valves 34, 44 follows the accelerator operation, the throttle shock may occur due to the output deviation of the front and rear cylinders 13, 14.

In the present embodiment in FIG. 10, when the accelerator is not operated at the time t1, the engine rotation speed is the idle rotation speed, the accelerator position is the fully closed position, the intake pressure of the rear cylinder 14 is an idle pressure, and the throttle positions of the front and rear throttle valves 34, 44 are the fully closed positions. The detection mode of the throttle shock is set to OFF, and the determination flag of the throttle shock is set to 0. When the shift position is changed from neutral at the time t2, the detection mode of the throttle shock is switched from OFF to ON.

The accelerator is operated at the time t3, and the detection time Tts of the throttle shock is set in the timer using the accelerator operation as the trigger. Therefore, the detection time Tts is counted down from the time 3. At the time t3, the accelerator position is moved from the fully closed position while the accelerator is operated, and the throttle position of the rear throttle valve 44 is moved from the fully closed position following the accelerator position. At this time, the front throttle valve 34 is maintained at a predetermined minute opening degree without following the accelerator position. The throttle shock is determined during the elapse of the detection time Tts of the throttle shock.

In the detection time Tts of the throttle shock, an accelerator operation speed ΔAP is calculated from a time differentiation of the accelerator position, and the change ΔPb in the intake pressure is calculated from a time differentiation of the intake pressure of the rear cylinder 14. With reference to the map data (see FIG. 8), when the accelerator operation speed ΔAP and the change ΔPb in the intake pressure are plotted in the region where the throttle shock occurs, it is determined that the throttle shock occurs, and the determination flag is set to 1. At the time t4 after the detection time Tts has elapsed, the front throttle valve 34 is opened at a lower speed than the rear throttle valve 44. That is, inclination of a speed V1 of the front throttle valve 34 is smaller than that of a speed V2 of the rear throttle valve 44 indicated by the broken line.

When the ignition signal is input to the front cylinder 13 at the time t4, the output deviation of the front and rear cylinders 13, 14 is reduced, and the throttle shock is prevented. When the output deviation of the front and rear cylinders 13, 14 falls within the predetermined range at the time t5, the front throttle valve 34 is opened at a higher speed than the rear throttle valve 44. That is, inclination of a speed V3 of the front throttle valve 34 is larger than that of the speed V2 of the rear throttle valve 44 indicated by the broken line. After the throttle shock has been prevented, the acceleration response is enhanced, and the acceleration feeling is improved. When the accelerator position is maintained at a constant opening degree, the detection mode of the throttle shock is switched from ON to OFF at a time t6, and the determination flag is set to 0.

Figure 11:
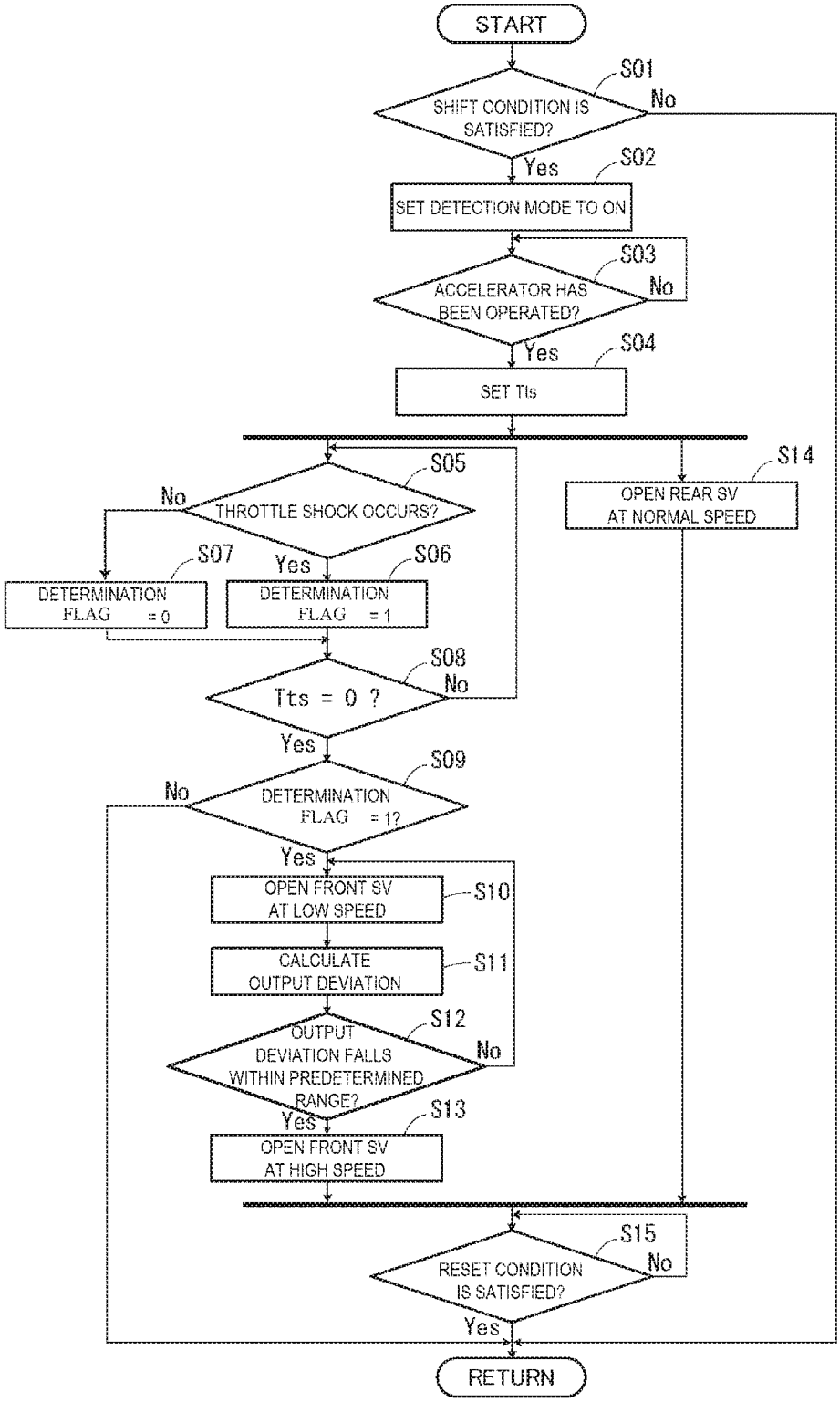
FIG. 11 is a flowchart of valve control according to the present embodiment.

Throttle shock reduction processing will be described with reference to FIG. 11. FIG. 11 is a flowchart of valve control according to the present embodiment. Here, the reference signs in FIGS. 5 and 7 will be used as appropriate for description.

As illustrated in FIG. 11, the control unit 80 determines whether the shift condition of the detection mode is satisfied (step S01). Here, it is determined that the shift condition of the detection mode is satisfied when the shift position is not neutral, the engine rotation speed is the idle rotation speed, and the front and rear throttle valves 34, 44 are fully closed. When the shift condition of the detection mode is not satisfied (No in step S01), the throttle shock reduction processing ends. When the shift condition of the detection mode is satisfied (Yes in step S01), the detection mode is set to ON, and monitoring of the throttle shock is started (step S02).

Next, based on output of the accelerator position sensor 53, the control unit 80 determines whether the accelerator has been operated (step S03). When it is determined that the accelerator has not been operated (No in step S03), the processing in step S03 is repeated until the accelerator grip 52 is moved from the fully closed position. When it is determined that the accelerator has been operated (Yes in step S03), the control unit 80 sets the detection time Tts of the throttle shock in the timer (step S04). The detection time Tts is counted down, and opening control of the front and rear throttle valves 34, 44 is performed in parallel.

In the opening control of the front throttle valve 34, the control unit 80 determines whether the throttle shock occurs (step S05). Whether the throttle shock occurs may be determined based on the accelerator operation speed and the change in the intake pressure, or may be determined only based on the accelerator operation speed. When it is determined that the throttle shock occurs (Yes in step S05), the control unit 80 sets the determination flag of the throttle shock to 1 (step S06). On the other hand, when it is determined that the throttle shock does not occur (No in step S05), the control unit 80 sets the determination flag of the throttle shock to 0 (step S07).

Next, the control unit 80 determines whether the detection time Tts=0 is satisfied (step S08). When the detection time Tts=0 is not satisfied (No in step S08), the processing in steps S05 to S08 is repeated until the detection time Tts elapses. When the detection time Tts=0 is satisfied (Yes in step S08), the control unit 80 determines whether the determination flag is 1 (step S09). When the determination flag is 0 (No in step S09), the throttle shock does not occur, so that the throttle shock reduction processing ends. When the determination flag is 1 (Yes in step S09), the throttle shock occurs, so that the front throttle valve 34 is driven to open at a lower speed than the rear throttle valve 44 (step S10).

Next, the control unit 80 estimates the output of the front and rear cylinders 13, 14 (step S11), and determines whether the output deviation between the front and rear cylinders 13, 14 falls within the predetermined range (step S12). When the output deviation does not fall within the predetermined range (No in step S12), the processing in steps S10 to S12 is repeated until the output deviation falls within the predetermined range. When the output deviation falls within the predetermined range (Yes in step S12), the front throttle valve 34 is driven to open at a higher speed than the rear throttle valve 44 (step S3).

In the opening control of the rear throttle valve 44, the rear throttle valve 44 is opened at a normal speed following the accelerator operation (step S14). Next, the control unit 80 determines whether a reset condition of the detection mode is satisfied (step S15). When predetermined time has elapsed in a state where the opening degrees of the front and rear throttle valves 34, 44 match, it is determined that the reset condition is satisfied. When the reset condition is satisfied (Yes in step S15), the detection mode is switched from ON to OFF, the determination flag is set to 0, and the throttle shock reduction processing ends. Further, when the accelerator has been operated in a direction in which the front and rear throttle valves 34, 44 are closed in steps S10 to S13, the throttle shock reduction processing ends.

As described above, according to the present embodiment, the front throttle valve 34 upstream of the front cylinder 13 is opened at a lower speed than the rear throttle valve 44 upstream of the rear cylinder 14. Therefore, the output deviation between the front and rear cylinders 13, 14 decreases, and the throttle shock that indicates the excessive acceleration response at the moment when the throttle is opened is prevented. The front throttle valve 34 is opened at a low speed, so that it is possible to prevent the decrease in the acceleration feeling and to improve the operability of the vehicle.

An example in which the control of the throttle valve according to the present embodiment is applied to a two-cylinder V-type engine, has been described. However, the present invention is not limited to this configuration. The control of the throttle valve according to the present embodiment may be applied to an engine having three or more cylinders, or may be applied not only to the V-type engine but also to an in-line engine or a horizontally opposed engine. For example, in the engine having three or more cylinders, the throttle valve upstream of the cylinder having the largest output is opened at a lower speed than rest of the throttle valves.

In the present embodiment, the throttle shock is prevented when the front and rear throttle valves are opened from the fully closed state. However, the present invention is not limited to this configuration. The throttle shock may be prevented when the front and rear throttle valves are opened from a predetermined opening degree.

In the present embodiment, it is determined whether the throttle shock occurs, and when the throttle shock occurs, the front throttle valve is opened at a lower speed than the rear throttle valve. However, the present invention is not limited to this configuration. The front throttle valve may be opened at a lower speed than the rear throttle valve without determining whether the throttle shock occurs. Therefore, the processing in steps S04 to S09 in FIG. 11 may be omitted.

In the present embodiment, the output of the front cylinder is larger than the output of the rear cylinder. However, the present invention is not limited to this configuration. The output of the rear cylinder may be larger than the output of the front cylinder. In this case, the rear exhaust pipe may be shorter than the front exhaust pipe.

In the present embodiment, the front cylinder and the rear cylinder separated from each other in a vehicle front-rear direction are exemplified as the plurality of cylinders. However, the present invention is not limited to this configuration. The plurality of cylinders may be formed side by side in a vehicle left-right direction without being divided into front and rear.

The engine according to the present embodiment includes the front cylinder and the rear cylinder. However, the present invention is not limited to this configuration. The engine may include a plurality of cylinders, and the output of a part of the plurality of cylinders may be larger than the output of rest of the plurality of cylinders. For example, the output of two cylinders among three or more cylinders may be larger than the output of rest of the cylinders. In this case, the throttle valves upstream of the two cylinders having large output are opened at a lower speed than the throttle valves upstream of the rest of the cylinders. When the engine includes three or more cylinders having different output, the throttle valves upstream of the plurality of cylinders may be opened at a low speed in descending order of the output of the cylinders.

The control of the throttle valve according to the present embodiment is applied to the motorcycle. However, the present invention is not limited to this configuration. The control of the throttle valve according to the present embodiment may be applied to other vehicles in which the throttle valve is provided, for example, special machines including a personal watercraft, a lawn mower, and an outboard motor in addition to an automatic four-wheeled vehicle and a buggy-type automatic three-wheeled vehicle.

The program of the control processing of the throttle valve according to the present embodiment may be stored in a storage medium. The storage medium is not particularly limited, and may be a non-transitory storage medium which is an optical disk, a magneto-optical disk, a flash memory, or the like.

As described above, an engine (10) according to the present embodiment includes: an engine main body (11) including a plurality of cylinders (13, 14); a plurality of throttle valves (34, 44) positioned on intake sides of the plurality of cylinders; and a controller (80) configured to control opening and closing operation of the plurality of throttle valves. Output of a part (the front cylinder 13) of the plurality of cylinders is larger than output of rest (the rear cylinder 14) of the plurality of cylinders. And the controller opens a part (the front throttle valve 34) of the throttle valves upstream of the part of the plurality of cylinders at a lower speed than rest (the rear throttle valve 44) of the throttle valves upstream of the rest of the plurality of cylinders. According to this configuration, the part of the throttle valves upstream of the part of the cylinders having large output is opened at a lower speed than the rest of the throttle valves upstream of the rest of the cylinders. Therefore, the output deviation of the plurality of cylinders decreases, and the throttle shock that indicates an excessive acceleration response at the moment when the throttle is opened is prevented. The part of the throttle valves is opened at a low speed, so that it is possible to prevent the decrease in an acceleration feeling and to improve the operability of the vehicle.

In the engine according to the present embodiment, the controller determines whether an excessive acceleration response is indicated for accelerator operation, and opens the part of the throttle valves at a lower speed than the rest of the throttle valves when determining that the excessive acceleration response is indicated. According to this configuration, when the throttle shock does not occur, the part of the throttle valves is not opened at a low speed. Therefore, it is possible to enhance the acceleration response and to further improve the operability of the vehicle.

In the engine according to the present embodiment, the controller determines whether the excessive acceleration response is indicated for accelerator operation based on an accelerator operation speed and a change in an intake pressure. According to this configuration, it is possible to accurately determine the throttle shock.

In the engine according to the present embodiment, the controller estimates output of the plurality of cylinders and determines whether output deviation of the plurality of cylinders falls within a predetermined range. The controller opens the part of the throttle valves at a lower speed than the rest of the throttle valves until the output deviation of the plurality of cylinders falls within the predetermined range. And after the output deviation of the plurality of cylinders has fallen within the predetermined range, the controller opens the part of the throttle valves at a higher speed than the rest of the throttle valves until opening degree of the part of the throttle valves matches opening degree of the rest of the throttle valves. According to this configuration, after the part of the throttle valves has been opened at a low speed and the throttle shock has been prevented, the part of the throttle valves can be opened at a high speed to improve the acceleration feeling and the operability of the vehicle.

In the engine according to the present embodiment, the controller opens throttle valves upstream of the plurality of cylinders at a low speed in a descending order of output of the plurality of cylinders. According to this configuration, it is possible to adjust an opening speed of the throttle valve according to magnitude of the output of the plurality of cylinders, and to improve the operability of the vehicle while preventing the throttle shock.

The engine according to the present embodiment further includes: a plurality of exhaust pipes (38, 48) connected to exhaust sides of the plurality of cylinders. A part (a front exhaust pipe 38) of the plurality of exhaust pipes connected to exhaust side of the part of the cylinders is shorter than rest (a rear exhaust pipe 48) of the plurality of exhaust pipes connected to exhaust side of the rest of the cylinders. According to this configuration, the output of the part of the cylinders connected to the short exhaust pipe tends to be larger than the output of the rest of the cylinders. Therefore, the part of the throttle valves upstream of the part of the cylinders is opened at a lower speed than the rest of the throttle valves, so that it is possible to prevent the throttle shock from occurring in the part of the cylinders.

In the engine according to the present embodiment, the plurality of cylinders are a front cylinder and a rear cylinder that are separated from each other in a vehicle front-rear direction, the part of the exhaust pipes is a front exhaust pipe connected to an exhaust side of the front cylinder, the rest of the exhaust pipes is a rear exhaust pipe connected to an exhaust side of the rear cylinder, the part of the throttle valves is a front throttle valve positioned on an intake side of the front cylinder, and the rest of the throttle valves is a rear throttle valve positioned on an intake side of the rear cylinder. According to this configuration, it is possible to improve the operability of the vehicle while preventing the throttle shock from occurring in the engine in which the plurality of cylinders are provided in the front-rear direction.

The vehicle according to the present embodiment is mounted with the above-described engine. According to this configuration, it is possible to improve the operability of the vehicle while preventing the throttle shock of the vehicle by controlling the opening and closing operation of the throttle valves according to the output of the plurality of cylinders.

According to the present embodiment, there is provided a method for controlling an engine including an engine main body including a plurality of cylinders, a plurality of throttle valves positioned on intake sides of the plurality of cylinders, and a controller configured to control opening and closing operation of the plurality of throttle valves, output of a part of the plurality of cylinders being larger than output of rest of the plurality of cylinders. The method includes: a determining step of determining whether an excessive acceleration response is indicated for throttle operation by the controller; and an opening step of opening a part of the throttle valves upstream of the part of the plurality of cylinders at a lower speed than rest of the throttle valves upstream of the rest of the plurality of cylinders when determining that the excessive acceleration response is indicated by the controller. According to this configuration, when the throttle shock occurs at a start of opening the throttle valves, the part of the throttle valves upstream of the part of the cylinders having large output is opened at a lower speed than the rest of the throttle valves upstream of the rest of the cylinders. Therefore, the output deviation of the plurality of cylinders decreases, and the throttle shock at the moment when the throttle is opened is prevented. The part of the throttle valves is opened at a low speed, so that it is possible to prevent the decrease in an acceleration feeling and to improve the operability of the vehicle.

In the determining step of the method for controlling the engine according to the present embodiment, whether the excessive acceleration response is indicated for accelerator operation is determined based on an accelerator operation speed and a change in an intake pressure, by the controller. According to this configuration, it is possible to accurately determine the throttle shock.

The method for controlling the engine according to the present embodiment, further includes: a step of estimating output of the plurality of cylinders and determining whether output deviation of the plurality of cylinders falls within a predetermined range by the controller. In the opening step, the part of the throttle valves is opened at a lower speed than the rest of the throttle valves by the controller until the output deviation of the plurality of cylinders falls within the predetermined range. And after the output deviation of the plurality of cylinders has fallen within the predetermined range, the part of the throttle valves is opened at a higher speed than the rest of the throttle valves by the controller until opening degree of the part of the throttle valves matches opening degree of the rest of the throttle valves. According to this configuration, after the part of the throttle valves has been opened at a low speed and the throttle shock has been prevented, the part of the throttle valves can be opened at a high speed to improve the acceleration feeling and the operability of the vehicle.

Although the present embodiment has been described, the above-described embodiment and the modification may be combined in whole or in part as another embodiment.

The technique of the present invention is not limited to the above-described embodiment, and various changes, substitutions, and modifications may be made without departing from the spirit of the technical idea of the present invention. Further, the present invention may be implemented using other methods as long as the technical ides of the present invention can be implemented by the methods through advance of the technology or other derivative technology. Accordingly, the claims cover all embodiments that may be included within the scope of the technical idea.

What is claimed is:

1. An engine comprising:

an engine main body including a plurality of cylinders;

a plurality of throttle valves positioned on intake sides of the plurality of cylinders; and a controller configured to control opening and closing operation of the plurality of throttle valves, wherein output of a part of the plurality of cylinders is larger than output of rest of the plurality of cylinders, wherein the controller opens a part of the throttle valves upstream of the part of the plurality of cylinders at a lower speed than rest of the throttle valves upstream of the rest of the plurality of cylinders, wherein the controller estimates output of the plurality of cylinders and determines whether output deviation of the plurality of cylinders falls within a predetermined range, wherein the controller opens the part of the throttle valves at a lower speed than the rest of the throttle valves until the output deviation of the plurality of cylinders falls within the predetermined range, and wherein, after the output deviation of the plurality of cylinders has fallen within the predetermined range, the controller opens the part of the throttle valves at a higher speed than the rest of the throttle valves until an opening degree of the part of the throttle valves matches an opening degree of the rest of the throttle valves.

2. The engine according to claim 1, wherein the controller determines whether an excessive acceleration response is indicated for accelerator operation, and opens the part of the throttle valves at a lower speed than the rest of the throttle valves when determining that the excessive acceleration response is indicated.

3. The engine according to claim 2, wherein the controller determines whether the excessive acceleration response is indicated for accelerator operation based on an accelerator operation speed and a change in an intake pressure.

4. The engine according to claim 1, wherein the controller opens throttle valves upstream of the plurality of cylinders at a low speed in a descending order of output of the plurality of cylinders.

5. The engine according to claim 1, further comprising:

a plurality of exhaust pipes connected to exhaust sides of the plurality of cylinders, wherein a part of the plurality of exhaust pipes connected to exhaust side of the part of the cylinders is shorter than rest of the plurality of exhaust pipes connected to exhaust side of the rest of the cylinders.

6. The engine according to claim 5, wherein the plurality of cylinders are a front cylinder and a rear cylinder that are separated from each other in a vehicle front-rear direction, wherein the part of the exhaust pipes is a front exhaust pipe connected to an exhaust side of the front cylinder, wherein the rest of the exhaust pipes is a rear exhaust pipe connected to an exhaust side of the rear cylinder, wherein the part of the throttle valves is a front throttle valve positioned on an intake side of the front cylinder, and wherein the rest of the throttle valves is a rear throttle valve positioned on an intake side of the rear cylinder.

7. A vehicle mounted with the engine according to claim 1.

8. A method for controlling an engine including an engine main body including a plurality of cylinders, a plurality of throttle valves positioned on intake sides of the plurality of cylinders, and a controller configured to control opening and closing operation of the plurality of throttle valves, output of a part of the plurality of cylinders being larger than output of rest of the plurality of cylinders, the method comprising:

a determining step of determining whether an excessive acceleration response is indicated for throttle operation by the controller;

an opening step of opening a part of the throttle valves upstream of the part of the plurality of cylinders at a lower speed than rest of the throttle valves upstream of the rest of the plurality of cylinders when determining that the excessive acceleration response is indicated by the controller; and a step of estimating output of the plurality of cylinders and determining whether an output deviation of the plurality of cylinders falls within a predetermined range by the controller, wherein, in the opening step, the part of the throttle valves is opened at a lower speed than the rest of the throttle valves by the controller until the output deviation of the plurality of cylinders falls within the predetermined range, and wherein, after the output deviation of the plurality of cylinders has fallen within the predetermined range, the part of the throttle valves is opened at a higher speed than the rest of the throttle valves by the controller until an opening degree of the part of the throttle valves matches an opening degree of the rest of the throttle valves.

9. The method for controlling the engine according to claim 8, wherein, in the determining step, whether the excessive acceleration response is indicated for accelerator operation is determined based on an accelerator operation speed and a change in an intake pressure, by the controller.

* * * * *